US006214140B1

(12) United States Patent
Machacek et al.

(10) Patent No.: US 6,214,140 B1
(45) Date of Patent: Apr. 10, 2001

(54) DEVELOPMENT OF NEW HIGH ENERGY BLASTING PRODUCTS USING DEMILITARIZED AMMONIUM PICRATE

(75) Inventors: Oldrich Machacek, Dallas, TX (US); Gary R. Eck, Sarcoxie, MO (US)

(73) Assignee: Universal Tech Corporation, Dallas, TX (US)

( * ) Notice: Subject to any disclaimer, the term of this patent is extended or adjusted under 35 U.S.C. 154(b) by 0 days.

(21) Appl. No.: 09/401,627

(22) Filed: Sep. 22, 1999

(51) Int. Cl.[7] ..... C06B 31/00; C06B 31/28; C06B 31/30; C06B 31/02

(52) U.S. Cl. ..... 149/46; 149/45; 149/60; 149/61; 149/47; 102/314; 102/318; 102/338

(58) Field of Search ..... 149/46, 45; 145/60, 145/61; 102/314, 318, 338

(56) References Cited

U.S. PATENT DOCUMENTS

| | | | | |
|---|---|---|---|---|
| Re. 33,788 | * | 1/1992 | Clay | 149/1 |
| 3,459,608 | * | 8/1969 | Ludolphy et al. | 149/46 |
| 3,773,573 | * | 11/1973 | Slykhouse | 149/21 |
| 4,300,962 | * | 11/1981 | Stinecipher et al. | 149/47 |
| 4,455,150 | * | 6/1984 | Olen | 149/36 |
| 4,828,633 | * | 5/1989 | Forsberg | 149/46 |
| 4,853,050 | * | 8/1989 | Bates et al. | 149/46 |
| 4,863,534 | * | 9/1989 | Forsberg | 149/46 |
| 4,872,929 | * | 10/1989 | Mullay | 149/46 |
| 4,992,119 | * | 2/1991 | Carlsen et al. | 149/2 |
| 5,431,757 | * | 7/1995 | Petterson et al. | 149/46 |
| 5,536,897 | | 7/1996 | Clark et al. | 688/202 |
| 5,596,165 | * | 1/1997 | Carney | 102/312 |
| 5,608,184 | | 3/1997 | Machacek | 149/98 |
| 5,612,507 | | 3/1997 | Clark et al. | 149/60 |
| 5,920,031 | * | 7/1999 | Jahnke | 149/2 |

* cited by examiner

*Primary Examiner*—Michael J. Carone
*Assistant Examiner*—Glenda L. Sánchez
(74) *Attorney, Agent, or Firm*—Henry D. Coleman; R. Neil Sudol

(57) ABSTRACT

As has been established, the use of energetic materials, generated by manufacturer's excess and/or demilitarization projects, as ingredients in commercial blasting explosives is a feasible and environmentally acceptable method of handling them. Ammonium picrate is used as an explosive charge in the manufacturing of conventional ammunition rounds, such as large caliber navy guns. The present invention is directed to the use of recovered ammonium picrate in commercial blasting agent compositions, that include water-gel slurries, ANFO, HANFO-blends and emulsion based blasting agents. These new blasting agents exhibit favorable cost for performance characteristics and have found a use for recovered ammonium picrate, which would heretofore have been incinerated or otherwise disposed of at significant cost.

18 Claims, No Drawings

DEVELOPMENT OF NEW HIGH ENERGY BLASTING PRODUCTS USING DEMILITARIZED AMMONIUM PICRATE

FIELD OF THE INVENTION

Several new high energy blasting products have been successfully developed using demilitarized ammonium picrate, and in particular, crystallized ammonium picrate. The new products have been shown to exhibit significantly enhanced characteristics as compared to similar products currently in use within the commercial explosives market. The present invention is directed to these novel blasting agent compositions and related processes.

BACKGROUND OF THE INVENTION

For many years, the most common disposal method of demilitarized explosives and propellants has been open burning/open detonation (OB/OD). Examples of more modern methods of disposal are incineration, thermal treatment and biodegradation. Each of these methods is a disposal technique for a hazardous waste material. Each requires expensive permitting and operational costs, as well as carrying less than desirable favor with the public. The study which culminated in the present application investigated the feasibility of the use of conventional demilitarized ammonium picrate, as a suitable ingredient in commercial explosives. The results presented herein indicate that the incorporation of ammonium picrate as an ingredient in a commercial explosive formulation proved to be safe, inexpensive (as compared to other methods) and an environmentally sound method for the alternate use of the material.

According to the U.S. Bureau of Mines (BOM), the estimated consumption of domestic and imported industrial explosives materials levels off at approximately 4 billion pounds per year. Explosives sales are recorded in 49 states, including Hawaii. Coal mining accounts for approximately 65–68% of the industrial explosives consumption. Quarrying and nonmetal mining accounts for 13–15%, while metal mining accounts for 10%. Construction and miscellaneous consumption accounts for 10–11%. Fifteen states account for 80% of the U.S. industrial explosives demand, of which 13 states produce 85% of our nation's coal.

Within the 4 billion pounds of commercial explosives consumption, approximately 600 million pounds of Class 1.5 watergel slury and emulsion type blasting agents are consumed. These types of explosives are used both in bulk form (delivered in bulk trucks to the borehole) and in packaged form. The exact size of the packaged market is not clear; however, this market presents the most feasible niche for the use of demilitarized materials. The incorporation of ammonium picrate into a packaged product offers the most controlled, safe and environmentally sound method of use.

OBJECTS OF THE INVENTION

It is an object of the invention to provide new blasting agent explosives, which incorporate quantities of the readily available ammonium picrate.

It is also an object of the present invention to provide a method of making commercial blasting agents from the readily available ammonium picrate.

It is a further object of the present invention to provide economical commercial blasting agents made from the readily available ammonium picrate.

It is yet another object of the present invention to provide an economical means of disposing of ammonium picrate without having to rely on traditional disposal methods, such as open detonation or incineration, which can be expensive and can cause pollution.

BRIEF DESCRIPTION OF THE INVENTION

The present invention relates to blasting agent compositions such as water gel slurries, ANFO compositions, HANFO-blend compositions and emulsions, which make use of ammonium picrate as an ingredient in effective amounts. It has unexpectedly been discovered that ammonium picrate may be reclaimed from military ammunition in amounts and in a form which can be readily used to produce blasting agent compositions according to the present invention. This is an unexpected result inasmuch as ammonium picrate, which has a relatively low sensitivity to detonation, can be used to produce a blasting agent which is competitive with commercial TNT compositions and provides virtually the same amount of energy as TNT in a commercial explosive. This results in an extremely efficient means of not only producing inexpensive commercially useful blasting agents, but also providing the added benefit of finding a commercial use for a seemingly useless military waste product, thus eliminating the need for expensive disposal. The present invention obviates the need to incinerate the large amounts of ammonium picrate, which can be found in military dumpsites.

In general, the present invention relates to blasting compositions which comprise an amount of ammonium picrate ranging from about one percent (1%) to about sixty percent (60%) of the total composition weight, as a water gel slurry composition, an ANFO composition, a HANFO composition or an emulsion composition. In many of the preferred compositions, according to the present invention, the amount of ammonium picrate ranges from about 5% to about 45%, more preferably about 10% to about 30% by weight of the final composition (which includes the ammonium picrate).

DETAILED DESCRIPTION OF THE INVENTION

The following terms shall be used in defining the present invention:

The term "Yellow D" refers to crystalline ammonium picrate, which is used as an ingredient in an explosive mixture, according to the present invention, that may be a watergel slurry, emulsion, ANFO-based composition, or HANFO-based composition. Yellow D or ammonium picrate is also known as ammonium 2,4,6-trinitrophenolate, Explosive D or Dunnite. Yellow D is oxygen deficient as an ingredient in explosives. It has an oxygen balance of −52.0 gm $O_2$/100 gm. Ammonium picrate exists in stable yellow and metastable red forms of orthorhombic crystals. It decomposes without melting at temperatures above 265° C. It has a crystalline density of 1.72 g/cc. Ammonium picrate is slightly soluble in water at ambient temperatures (0.7 gms/100 gms water at 10° C. and 1.02 gms/100 gms water at 20° C.), but is very soluble in hot water (75 gms/100 gms water at 100° C.).

Ammonium picrate for use in the present invention may be readily obtained from military storage or directly from the munitions by washing the ammonium picrate out of the shells, and then using the composition, which contains the ammonium picrate (either as a water/ammonium picrate mixture or as crystalline ammonium picrate), to produce commercial explosive compositions according to the present invention. Whether the ammonium picrate is obtained from bulk ammunitions or from artillery charges (from heavy artillery, such as large caliber navy guns), the ammonium picrate is used as an explosive ingredient in the commercial explosive compositions.

The term "blasting agent" or "Explosive composition" is used to describe compositions according to the present invention, which include water gel slurry compositions, water-in-oil emulsion compositions, ANFO compositions or HANFO compositions, which include an effective amount, i.e., about 1% to about 60% or more by weight of ammonium picrate. Blasting agents are used as commercial explosives in combination with a suitably sized explosive booster.

The term "watergel slurry" or "watergel composition" refers to commonly known commercial explosives which includes ammonium nitrate as a primary oxidizer, water, fuel and/or sensitizers, additional oxidizers, guar gum, xantham gum or a related thickener or gelling agent and crosslinker. The watergel slurry's liquid phase contains the water soluble oxidizer salts and fuels dissolved in the slurry's water. This aqueous solution is thickened by a small amount of thickener, such as guar gum, a cellulose ether or related thickener or gelling agent. The compositions may optionally include a gum dispersent or diluent, such as ethylene glycol, to provide uniformity to the thickening. The thickened solution is then mixed with additional solid oxidizer salts and fuels to produce a fluid slurry. The resulting slurry is then cross-linked with a suitable crosslinker (such as an antimony or chromium salt).

Fuel and/or secondary sensitizers, such as methylamine nitrate, hexamine nitrate, paint-grade aluminum etc., impart sensitivity to detonation. Inert glass microspheres or chemically generated gas bubbles provide further sensitivity to detonation in the resulting slurry. This gel-type product has the consistency of thick yogurt. The ratio of fuel to oxidizer is adjusted to a final oxygen balance close to zero ±10% in order to achieve the maximum energy content. The term "oxygen balance" is used to describe the amount of oxygen containing components in comparison to non-oxygen containing components. One of the ordinary skill will readily recognize how to adjust the fuel content and oxidizer content in order to maximize energy content according to the present invention.

Each of the above constituents of the watergel compositions according to the present invention, is used in effective amounts. Generally, the ammonium nitrate is included in amounts ranging from about 40% to about 75% by weight of the composition, water is used in amounts ranging from about 5% to about 25%, more preferably about 10% to about 20% by weight, fuels and/or secondary sensitizers are used in amounts ranging from about 2% to about 25% by weight; additional oxidizers are used in amounts ranging from about 0% to about 30% by weight; a thickener or gelling agent is included in amounts ranging from about 0.1% to about 5% by weight, a crosslinking agent is included in an amount ranging from about 0.1% to about 1.0% by weight, and glass microspheres, if used, range from about 0.5% to about 5% by weight of the final composition.

After formulating the watergel composition, ammonium picrate is added to the composition in amounts ranging from about 1% to about 60% by weight of a final composition, comprising the above-referenced water gel composition and ammonium picrate. More preferably, the amount of ammonium picrate comprises about 10% to about 30% by weight of the watergel composition, which includes the ammonium picrate. Depending upon the form of ammonium picrate added (which can be in the form of crystalline material or material which contains water, depending upon where and how the material is obtained), care should be taken to calculate the amount of ammonium picrate in the total mixture. After adding the ammonium picrate to the watergel composition, the final composition may be optionally crosslinked using a standard crosslinking agent compatible with the use of the gelling agent chosen. Crosslinking agent, when used, comprises about 0.05% to about 1% or more by weight of the composition.

Some ingredients used in a typical watergel composition are shown in the following list:

| Ingredients | Function |
|---|---|
| Ammonium Nitrate | Primary Oxidizer |
| Sodium, Calcium Nitrate | Secondary Oxidizer |
| Methylamine Nitrate | Sensitizer, Fuel |
| Hexamethylenetetramine | Sensitizer, Fuel |
| Aluminum (Granular, Atomized, Flake) | Sensitizer, Fuel |
| Ethylene Glycol | Gum Dispersion Diluent, Fuel |
| Water | Fluidizer |
| Guar Gum | Gelling Agent |
| Ammonium, Potassium, Sodium Perchlorate | Oxidizer, Sensitizer |
| Glass Microspheres | Sensitizer |

DESCRIPTION OF MANUFACTURING PROCESS OF WATERGELS

The production of a watergel slurry explosive is a relatively simple process which incorporates two basic steps. First, the slurry's liquid phase (which normally constitutes about 30–60% of the final product) is produced. The second step entails the blending of the liquid phase with any additional dry nitrate salts, aluminum powders, dry fuels and gelling agents. The blending process is utilized to homogenize the mixture and most importantly to entrain air into the mixture (unless chemical gassing or glass microspheres are used). Air is entrained until the desired density of the product is achieved. When ready to package, the mixture has the consistency of thick oatmeal, which can be easily pumped into a package.

The necessary equipment consists basically of temperature-controlled storage tanks, a mixing chamber, and packaging equipment. The process is easily made to be closed-loop, with no effluents being presented for treatment or disposal. All scrap materials are recycled, as is any wash water which might be generated. The production process can be made modular, completely contained and inexpensive to capitalize. Production facilities could be established in the same area as the demilitarization operation to increase the economy of the approach.

The term, "emulsion" refers to commonly known commercial explosives based on an aqueous oxidizer solution dispersed in an immiscible organic fuel phase (water-in-oil emulsion). The emulsion's discontinuous aqueous phase contains various oxidizer salts (ammonium nitrate, sodium nitrate, calcium nitrate, sodium perchlorate, etc.) dissolved in water at an elevated temperature. This aqueous solution is emulsified at an elevated temperature into a continuous fuel phase, which contains an immiscible fuel, such as diesel fuel, a mineral oil or a related hydrocarbon, and a special emulsifier such as a non-ionic emulsifier, for example, a fatty acid ester of sorbitan such as sorbitan monoeleate (Span 80™), among other emulsifiers. Generally, in emulsions, the oxidizer salts (mainly ammonium nitrate) comprises about 40–90% by weight of the formula, more preferably about 50% to about 85% by weight. The amount of water generally ranges from about 5–25%, more preferably about 10% to about 20% by weight. The fuel generally comprises about 1–15% by weight, more preferably about 3% to about 10% by weight. The amount of emulsifier is that amount effective to produce an emulsion, generally within the range of about 0.5–10% by weight, more preferably about 1% to about 5% by weight. Sensitizers may be optionally added, and when added are included in amounts ranging from about 1% to about 10% by weight. Glass or plastic microspheres and/or chemically generated gas are added as sensitizers.

The final emulsion is of the water-in-oil type (w/o). A small amount of glass microspheres or chemically generated gassing provides additional sensitivity to detonation. Mineral oil, diesel fuel and related hydrocarbons serve as fuel. The final product has the consistency of mayonnaise and can be pumped directly into packages. The continuous fuel phase is not water-soluble and guarantees resistance to water. In the present invention, an amount of ammonium picrate is added to emulsion compositions in an amount ranging from about 2% to about 50%, more preferably about 10% to about 25% by weight of the emulsion plus the ammonium picrate.

The term, "ANFO based composition" refers to the most commonly used commercial explosive that comprises ammonium nitrate and a fuel in combination, preferably approximately 96% ammonium nitrate and approximately 6% diesel fuel. It is a dry mix that is not suitable for application in wet boreholes, unless some type of artificial water barrier is applied (plastic bag, borehole liner, etc.). The composition is generally prepared by allowing ammonium nitrate to absorb diesel fuel, and the dry mix is used as the final composition. In the present invention, dry ammonium picrate, in an amount ranging from about 1% to about 30% by weight of the combination of ANFO based composition and ammonium picrate, is used in a final explosive composition. In many applications, the explosive composition may be prepared by mixing the ANFO based composition in a bowl type mixer to absorb the fuel into the ammonium nitrate. The ammonium picrate may be added to the ANFO based composition and mixed thoroughly.

The term, "HANFO based" composition refers to a mixture of ANFO in combination with a water-in-oil emulsion composition as generally described above. In general, the amount of emulsion included in HANFO based compositions ranges from about 15% to about 85% by weight, with a preferred range being above about 60%. Usually, mixtures with a higher content of emulsion (i.e., greater than 60%) can be pumped, while mixtures with a lower emulsion content (i.e., less than 50%) are too stiff to pump and are usually transferred with auger. In compositions according to the present invention, ammonium picrate is added to the HANFO compositions in amounts ranging from about 1% to about 50% by weight of the combined mixture of HANFO and ammonium picrate. Preferably, the amount of ammonium picrate included in compositions according to the present invention ranges from about 10% to about 30% by weight of the combined ammonium picrate and HANFO composition.

The term "shock energy" refers to the energy produced by high pressure shock wave generated during the detonation. Shock energy is the energy which causes the fracturing of rock or other material.

The term "bubble energy" refers to the energy produced by the expansion of the high temperature/high pressure gaseous detonation products, generated during the detonation. These gaseous detonation products serve to enhance the fractures in the rock, produced by the shock wave, which ultimately results in the desired breakage and displacement of the rock.

The term "booster" is used to describe the detonator sensitive explosive material, which is capable of generating enough explosive energy to readily initiate the detonation of the explosive compositions according to the present invention.

The term "critical diameter" is used to describe the smallest charge diameter of an explosive material in which a sustainable detonation can occur. In general, the critical diameter of the packaged explosives, according to the present invention, ranges from about one inch up to about six inches, depending upon the final composition of the explosive composition.

The term "effective amount" is used to describe amounts of components which are included in blasting agent compositions according to the present invention. An effective amount of a component is that amount which is included in a composition in order for that component to elicit its intended effect in the final composition. For example, in the case of including a thickening agent or gelling agent, an effective amount of such an agent is that amount which thickens or gels (i.e., increases the viscosity of) the composition.

The term "consisting essentially of" is used in the present specification consistent with the meaning as it has attained within the law. That is, a composition which consists essentially of at least one component embraces that component or components specifically set forth or enumerated and any additional component not set forth or enumerated which, when added to the composition would not change the basic and novel characteristics of the claimed compositions and/or methods. In the present invention, the basic and novel characteritsics of the compositions and methods relate to the use of ammonium picrate in effective amounts to produce a blasting agent when combined with other components. The term "comprising" is used as a more open-ended term consistent with its definition known in the art.

The present invention therefore, relates to the inclusion of effective quantities of ammonium picrate (i.e., between about 1% and about 60% or more by weight of the final compositions) in watergel slurries, emulsions, ANFO compositions and HANFO compositions as generally described above, in order to provide explosive compositions which make use of or include a material, ammonium picrate, which is recovered from munitions or is used for a purpose other than in munitions. It is an unexpected result, that the inclusion of effective quantities of ammonium picrate within the range of about 1% to about 60% or more by weight of the final explosive composition, when added to the prior art compositions as described above, would produce commercially viable explosive compositions exhibiting explosive characteristics consistent with compositions which utilize significantly more expensive compounds (such as TNT) than the present compositions.

The following examples are provided to illustrate the present invention and should not be seen or interpreted to limit the scope of the present invention in any way.

EXAMPLE 1

Tests were done to evaluate the various concentrations of Yellow D ranging from 35% to 50% as an energetic fuel and sensitizer in a generic watergel slurry matrix. Hexamine was added at a 1% level for buffering purposes. Ammonium nitrate was used as the main oxidizing salt, while a 5% level of sodium nitrate was added as an additional oxidizer. The slurry's total water content was maintained at about 16%, except for the 50% Yellow D mixes, where an additional 2% water was added for increased fluidity. A 2% level of ethylene glycol was used for guar gum dispersion.

The air-dried Yellow D, that was used in these test mixes, contained an average 3–5% residual water. Adjustments were made for a 15% moisture content (based upon total weight of water and ammonium picrate). Since the classification of Yellow D as a flammable solid requires a minimum of 10% water; it was assumed that this raw material would be made available with a water content of about 15%. These four basic slurry formulations are given in Table 1. Four tests were done with varying concentrations of the water wet Yellow D incorporated in the watergel slurry matrix. Mechanically entrained air was used to adjust the slurry's final density into the 1.20–1.25 g/cc range. All four watergel slurry products exhibited firmly crosslinked gel textures. The detonation test data are given in Table 2.

The test data generated on the four watergel slurry mixes indicated that the reclaimed crystalline Yellow D could be used as an energetic ingredient in a watergel slurry explosive. The Yellow D was shown to enhance the explosive's sensitivity and detonation velocity as its concentration increased. At least 40% Yellow D was preferably used for detonation in a 3 inch unconfined charge. Further tests showed that at least 45% Yellow D was preferably used for a 3 inch diameter blasting agent slurry (unconfined critical diameter of at least 2.5 inches at 40° F.). Furthermore, a 50% level of the crystalline Yellow D was about the maximum that could be used to maintain a slurry exhibiting a rheology useful for a readily mixable product.

TABLE 1

Yellow D Slurry Formulations

| Ingredients | Mix A | Mix B | Mix C | Mix D |
|---|---|---|---|---|
| Water (total in slurry) | 16.05% | 16.05% | 16.05% | 18.05% |
| Hexamine | 1.00% | 1.00% | 1.00% | 1.00% |
| 100% Nitric Acid | 0.45% | 0.45% | 0.45% | 0.45% |
| Ammonium Nitrate | 39.70% | 34.70% | 29.80% | 22.80% |
| Sodium Nitrate | 5.00% | 5.00% | 5.00% | 5.00% |
| Ethylene Glycol | 2.00% | 2.00% | 2.00% | 2.00% |
| Gum & Crosslinker | 0.80% | 0.80% | 0.70% | 0.70% |
| Yellow D (dry basis) | 35.00% | 40.00% | 45.00% | 50.00% |
| | 100.00% | 100.00% | 100.00% | 100.00% |

TABLE 2

Yellow D Slurry Detonation Test Data
These unconfined charges were shot on the surface and primed with 1 pound cast booster. The VOD (Velocity of Detonation) values are expressed in feet/second.

| Product | % Yellow D | Density (g/cc) | Charge Diameters 3 inches | 2.5 inches | 2 inches |
|---|---|---|---|---|---|
| A) 70° F. Shooting Data: | | | | | |
| Mix A | 35 | 1.26 | 15,550 | 14,580 | Fail |
| Mix B | 40 | 1.24 | 16,010 | 13,400 | Fail |
| Mix C | 45 | 1.24 | 16,670 | — | — |
| Mix D | 50 | 1.24 | 16,390 | — | — |

TABLE 2-continued

Yellow D Slurry Detonation Test Data
These unconfined charges were shot on the surface and primed with 1 pound cast booster. The VOD (Velocity of Detonation) values are expressed in feet/second.

| Product | % Yellow D | Density (g/cc) | Charge Diameters 3 inches | 2.5 inches | 2 inches |
|---|---|---|---|---|---|
| B) 40° F. Shooting Data: | | | | | |
| Mix A | 35 | 1.24 | Det. | Fail | — |
| Mix B | 40 | 1.24 | 15,580 | Fail | — |
| Mix C | 45 | 1.25 | 16,840 | 15,290 | Fail |
| Mix D | 50 | 1.24 | 17,480 | 16,340 | Fail |

EXAMPLE 2

Evaluations of Yellow D were done in a more sensitive watergel slurry matrix. The Hexamine content in the watergel slurry matrix was increased from 1% to 6%. This was accompanied with a comparative increase in nitric acid and the addition of ammonium perchlorate as a sensitizer. The total water content of the slurry was maintained at about 15%. A 2% level of ethylene glycol was used for gum dispersion.

The same air-dried Yellow D (Example 1) was used, which contained an average 3–5% residual water. Once again, adjustments were made for a 15% moisture content, since the classification of Yellow D as a flammable solid required a minimum of 10% water. Two basic slurry formulations were used; These slurry formulations are given in Table 3. The 40% Yellow D formulation proved to produce a fairly fluid slurry product, while the 50% Yellow D formulation produced a fairly dry and stiff slurry. The 50% Yellow D slurry would probably present some production problems using normal explosive slurry mixing and pumping equipment. All the products exhibited firmly crosslinked gel textures. The unconfined critical diameter/VOD (Velocity of Detonation) test data are given in Table 4. The underwater energy test data are given in Table 5.

The watergel slurry detonation test data generated on the two watergel slurry mixes showed that the addition of both 40% and 50% Yellow D proved to produce viable explosive products. Although the 50% Yellow D slurry (Mix B) produced a slightly faster unconfined velocity of detonation; the more fluid slurry rheology of the 40% Yellow D slurry would make it easier to manufacture. Furthermore, both slurry products proved to have unconfined critical diameters of at least 2 inches at 70° F. and 2.5 inches at 40° F. Additionally, the underwater energy test data showed the 40% Yellow D slurry (Mix A) to produce a 7% higher Total Energy, than the 50% Yellow D slurry (Mix B). This was caused by a 6% higher Shock Energy component and a 8% higher Bubble Energy component.

TABLE 3

Yellow D Hexamine Slurry Formulations

| Ingredients | Mix E | Mix F |
|---|---|---|
| Water (total in slurry) | 15.03% | 15.03% |
| Hexamine | 6.00% | 5.00% |
| 100% Nitric Acid | 2.57% | 2.17% |
| Ammonium Nitrate | 26.10% | 18.10% |
| Ammonium Perchlorate | 2.50% | 2.00% |
| Sodium Nitrate | 5.00% | 5.00% |
| Ethylene Glycol | 2.00% | 2.00% |

TABLE 3-continued

Yellow D Hexamine Slurry Formulations

| Ingredients | Mix E | Mix F |
|---|---|---|
| Gum & Crosslinker | 0.80% | 0.70% |
| Yellow D (dry basis) | 40.00% | 50.00% |
| | 100.00% | 100.00% |
| Slurry Mix Density: | 1.19 g/cc | 1.19 g/cc |

TABLE 4

VOD Data For Hexamine Yellow D Slurries
These VOD values were measured on unconfined charges primed with 1 pound cast boosters. The VOD values are reported in feet/second. (Note: Product Mix E contains 40% Yellow D while Product Mix F contains 50% Yellow D.)

| Product | Charge Dia. (in.) | Temp. (° F.) | Density (g/cc) | VOD (f/s) |
|---|---|---|---|---|
| Mix E | 4 | 70 | — | 17,120 |
| Mix E | 3 | 70 | 1.22 | 16,230 |
| Mix E | 2.5 | 70 | — | 15,350 |
| Mix E | 2 | 70 | — | 13,250 |
| Mix F | 4 | 70 | — | 18,120 |
| Mix F | 3 | 70 | 1.25 | 16,290 |
| Mix F | 2.5 | 70 | — | 15,350 |
| Mix F | 2 | 70 | — | 13,660 |
| Mix E | 3 | 40 | — | 15,480 |
| Mix E | 2.5 | 40 | — | 15,390 |
| Mix E | 2 | 40 | — | Fail |
| Mix F | 3 | 40 | — | 15,840 |
| Mix F | 2.5 | 40 | — | 15,480 |
| Mix F | 2 | 40 | — | Fail |

TABLE 5

Energy Data For Hexamine Yellow D Slurries
These energy values were measured on 6 inch diameter unconfined charges, using the underwater bubble energy test. The charges were primed with one pound cast boosters, and shot at a temperature of 22° C. The energy values are reported in calories/gram. (Note: Product Mix E contains 40% Yellow D while Product Mix F contains 50% Yellow D.)

| Products | Shock Energy | Bubble Energy | Total Energy |
|---|---|---|---|
| Mix E | 330 | 387 | 717 |
| Mix F | 312 | 360 | 672 |

EXAMPLE 3

Two ANFO compositions were made containing 20% and 40% levels of dry crystalline Yellow D. The two dry explosive products were made by mixing the dry Yellow D with ANFO (94 parts low density amnonium nitrate prills and 6 parts #2 fuel oil) at the required weight percentages. The 20% Yellow D mix had a bulk density of 0.98 g/cc, as compared to a 0.87 g/cc for the standard ANFO. The 40% Yellow D mix had a bulk density of 1.01 g/cc. Unconfined detonation test data (Table 6) showed that the addition of 20% and 40% levels of dry Yellow D to ANFO resulted in 1,500 to 3,000 f/s increases in unconfined VOD. The underwater energy test data (Table 7) showed the Yellow D to increase ANFO's Shock Energy component, while reducing its Bubble Energy component. With either addition of Yellow D, no significant change in the ANFO's measured Total Energy occurred. However, the most dramatic increase occurred with the addition of the first 20% Yellow D. With a higher density, the Yellow D addition produced a 10% to 15% increase in energy per unit volume, based upon the measured Total Energy from the underwater energy.

TABLE 6

VOD Data For ANFO/Yellow D Compositions
These VOD values were measured on unconfined charges primed with 1 pound cast boosters. The VOD values are reported in feet/second.

| Product | Charge Dia. (in.) | Temp. (° F.) | Density (g/cc) | VOD (f/s) |
|---|---|---|---|---|
| ANPO Std. | 6 | 70 | 0.87 | 12,470 |
| ANFO + 20% Yellow D | 6 | 70 | 0.98 | 13,970 |
| ANFO + 40% Yellow D | 6 | 70 | 1.01 | 15,430 |

TABLE 7

Energy Data For ANFO/Yellow D Compositions
These energy values were measured on 6 inch diameter unconfined charges, using the underwater bubble energy test. The charges were primed with one pound cast boosters, and shot at a temperature of 22° C. The energy values are reported in calories/gram.

| Products | Shock Energy | Bubble Energy | Total Energy |
|---|---|---|---|
| ANFO Std. | 348 | 519 | 867 |
| ANFO + 20% Yellow D | 381 | 496 | 877 |
| ANFO + 40% Yellow D | 390 | 474 | 864 |

EXAMPLE 4

Dry crystalline Yellow D was blended with a typical water-in-oil emulsion explosive at 20% and 40% levels. The emulsion explosive was a typical water-in-oil composition, which contained 16% water, mineral oil and PIBSA emulsifier as the organic fuel phase, 1% glass bubbles as a sensitizer, and ammonium nitrate as the sole oxidizer salt. At a 20% level of Yellow D, the resultant blend was still fairly fluid and had a density of 1.29 g/cc. At a 40% level of Yellow D, the resultant blend was fairly stiff and dry, and had a density of 1.35 g/cc. The emulsion/Yellow D products were tested for unconfined VOD (Table 8) and energy (Table 9). These test data showed that the addition of 20% and 40% levels of dry Yellow D to a sensitized bulk emulsion resulted in a slight increase in unconfined VOD. The underwater energy data showed the addition of the Yellow D significantly increases the emulsion's energy, in particular, the Shock Energy Component, but had little effect upon its Bubble Energy component. The most significant energy gain occurred with the addition of the first 20% of Yellow D. The overall result was a 6% to 9% increase in Total Energy. With the higher density of the Yellow D mixes, the Yellow D addition produced a 6% to 17% increase in energy per unit volume, based upon the measured Total Energy from the underwater energy test.

TABLE 8

VOD Data For Emulsion/Yellow D Compositions
These VOD values were measured on unconfined charges primed with 1 pound cast boosters. The VOD values are reported in feet/second.

| Product | Charge Dia. (in.) | Temp. (° F.) | Density (g/cc) | VOD (f/s) |
|---|---|---|---|---|
| Emulsion Std. | 4 | 70 | 1.25 | 19,000 |
| Emulsion + 20% Yellow D | 4 | 70 | 1.29 | 19,305 |
| Emulsion + 40% Yellow D | 4 | 70 | 1.35 | 20,000 |

TABLE 9

Energy Data For Emulsion/Yellow D Compositions
These energy values were measured on 6 inch diameter unconfined charges, using the underwater bubble energy test. The charges were primed with one pound cast boosters, and shot at a temperature of 22° C. The energy values are reported in calories/gram.

| Products | Shock Energy | Bubble Energy | Total Energy |
|---|---|---|---|
| Emulsion Std. | 331 | 381 | 712 |
| Emulsion + 20% Yellow D | 368 | 387 | 755 |
| Emulsion + 40% Yellow D | 387 | 389 | 776 |

EXAMPLE 5

The preparation of the HANFO blend composition involved the mixing of 60% of the previously sensitized emulsion and 40% ANFO (94/6). This standard HANFO blend proved to be fairly fluid and had a bulk density of 1.29 g/cc. The dry crystalline Yellow D was then mixed with this 60/40 HANFO blend at a 20% level (80 parts HANFO and 20 parts Yellow D). The resulting mixture had a density of 1.35 g/cc. The HANFO/Yellow D mix was tested for unconfined VOD (Table 10) and energy (Table 11). The test data showed that the addition of 20% dry Yellow D to the 60/40 HANFO blend resulted in about 1 1,000 f/s faster unconfined VOD. It also produced an 11% increase in the Shock Energy component, a 5% increase in Bubble Energy component, and an overall increase of 7% in Total Energy. With the higher density of the Yellow D mix, its addition produced a 12% increase in energy per unit volume, based upon the measured Total Energy from the underwater energy test.

TABLE 10

VOD Data For HANFO/Yellow D Compositions
These VOD values were measured on unconfined charges primed with 1 pound cast boosters. The VOD values are reported in feet/second.

| Product | Charge Dia. (in.) | Temp. (° F.) | Density (g/cc) | VOD (f/s) |
|---|---|---|---|---|
| 60/40 HANFO Std. | 4 | 70 | 1.29 | 14,200 |
| 60/40 HANFO + 20% Yellow D | 4 | 70 | 1.35 | 15,100 |

TABLE 11

Energy Data For HANFO/Yellow D Compositions
These energy values were measured on 6 inch diameter unconfined charges, using the underwater bubble energy test. The charges were primed with one pound cast boosters, and shot at a temperature of 22° C. The energy values are reported in calories/gram.

| Products | Shock Energy | Bubble Energy | Total Energy |
|---|---|---|---|
| 60/40 HANFO Std. | 224 | 310 | 534 |
| 60/40 HANFO + 20% Yellow D | 249 | 326 | 575 |

It is to be understood that the examples and embodiments described hereinabove are for the purposes of providing a description of the present invention by way of example and are not to be viewed as limiting the present invention in any way. Various modifications or changes that may be made to that described hereinabove by those of ordinary skill in the art are also contemplated by the present invention and are to be included within the spirit and purview of this application and the following claims.

We claim:

1. A blasting agent comprising an effective amount of ammonium picrate added to a composition selected from the group consisting of a watergel slurry composition, a water-in-oil emulsion composition, an ANFO composition and a HANFO composition, said ammonium picrate comprising about 1% to about 60% by weight of said blasting agent.

2. The blasting agent according to claim 1 comprising about 1% to about 50% by weight ammonium picrate.

3. The blasting agent according to claim 2 comprising a watergel slurry composition, wherein said watergel slurry composition comprises ammonium nitrate as a primary oxidizer, water, fuels and/or sensitizers, a gelling agent, a crosslinking agent and optionally, additional oxidizer salts.

4. The blasting agent according to claim 3 wherein said ammonium nitrate is included in said agent in an amount ranging from about 40% to about 75% by weight of the watergel slurry composition, said water is included at an amount ranging from about 5% to about 25% by weight of said watergel slurry composition, said fuel and/or sensitizers are included in an amount ranging from about 2% to about 20% by weight of said watergel slurry composition, said additional oxidizers are included in an amount ranging from 0% to about 25% by weight of said watergel slurry composition.

5. The blasting agent according to claim 3 wherein said gelling agent is selected from guar gum or a cellulose ether and is included in an amount ranging from about 0.1% to about 5% by weight of said watergel slurry composition and said crosslinking agent is included in an amount ranging from about 0.1% to about 3.0% by weight of said watergel slurry composition.

6. The blasting agent according to claim 1 comprising a water-in-oil emulsion composition containing ammonium nitrate, water, organic fuels, emulsifiers and optionally a sensitizer and other inorganic oxidizer salts.

7. The blasting agent according to claim 6 wherein said ammonium nitrate comprises about 40% to about 90% by weight of said emulsion composition, said water comprises about 10% to about 20% by weight of said emulsion composition, said fuel comprises about 1% to about 15% by weight of said emulsion composition and said emulsifier comprises an effective amount to produce an emulsion.

8. The blasting agent according to claim 7 further including secondary oxidizer salts in an amount ranging from about 5% to about 15% by weight of said emulsion composition.

9. The blasting agent according to claim 1 wherein free space bulking agents, air or chemically generated gas have been added in amounts effective to increase sensitivity of said agent to detonation.

10. The blasting agent according to claim 1 further in combination with a booster.

11. The blasting agent according to claim 1 comprising an ANFO composition containing ammonium nitrate, diesel fuel and about 1% to about 40% by weight ammonium picrate.

12. The blasting agent according to claim 11 wherein said ammonium picrate comprises about 1% to about 40% by weight and said ammonium nitrate and diesel fuel are included in said blasting agent in a weight ratio of about 94:6.

13. The blasting agent according to claim 1 comprising a HANFO composition and an amount of ammonium picrate ranging from about 1% to about 50% by weight of said blasting agent.

14. The blasting agent according to claim 13 wherein said HANFO composition comprises about 15% to about 85% by weight of an ANFO composition and about 15% to about 85% by weight of a water-in-oil emulsion composition.

15. The blasting agent according to claim 14 wherein said ANFO composition comprises ammonium nitrate and diesel fuel in a weight ratio of about 94:6 and said water-in-oil emulsion composition comprises ammonium nitrate, water, fuels, emulsifiers and optionally a sensitizer.

16. The blasting agent according to claim 15 wherein said ammonium nitrate comprises about 40% about 90% by weight of said water-in-oil emulsion composition, said water comprises about 10% to about 20% by weight of said water-in-oil emulsion composition, said fuel comprises about 1% to about 15% by weight of said water-in-oil emulsion composition and said emulsifier comprises an effective amount to produce an emulsion.

17. The blasting agent according to claim 1 wherein said ammonium picrate comprises about 5% to about 45% by weight.

18. The blasting agent according to claim 1 wherein said ammonium picrate comprises about 10% to about 45% by weight.

* * * * *